United States Patent [19]

Bellino

[11] Patent Number: 4,525,703

[45] Date of Patent: Jun. 25, 1985

[54] PORTABLE SMOKE ALARM

[75] Inventor: Joseph P. Bellino, Shelton, Conn.

[73] Assignee: General Electric Company, New York, N.Y.

[21] Appl. No.: 410,361

[22] Filed: Aug. 23, 1982

[51] Int. Cl.[3] ..... G08B 17/10

[52] U.S. Cl. ..... 340/628; 116/307; 200/308; 248/214; 340/546

[58] Field of Search ..... 340/628, 546; 361/428, 361/352; 179/178, 156 R, 156 A, 70, 77, 91 A, 95; 381/74; 455/349; 200/161, 52 R, 61.19, 61.03, 308; 116/307, 323, 325, 326; 248/214, 359 C, 359 I

[56] References Cited

U.S. PATENT DOCUMENTS

| | | | |
|---|---|---|---|
| 324,591 | 8/1885 | Price et al. | 179/95 X |
| 1,968,546 | 7/1934 | Van Dyck | 455/349 X |
| 2,146,577 | 2/1939 | Hermann | 200/308 X |
| 2,424,966 | 8/1947 | Buchanan et al. | 361/352 X |
| 2,855,257 | 10/1958 | Barker et al. | 455/349 X |
| 2,908,899 | 10/1959 | Crafts | 200/61.19 X |
| 3,430,220 | 2/1969 | Deuth | 340/630 |
| 3,710,365 | 1/1973 | Barnes | 340/630 |
| 4,258,359 | 3/1981 | McLamb | 340/546 |

FOREIGN PATENT DOCUMENTS

| | | | |
|---|---|---|---|
| 26867 | of 1908 | United Kingdom | 179/70 |

*Primary Examiner*—James L. Rowland
*Assistant Examiner*—Daniel Myer
*Attorney, Agent, or Firm*—George R. Powers

[57] ABSTRACT

A portable alarm is provided with a smoke detecting mechanism and circuit connected to an audible signal activated on the presence of smoke and all contained in a compact housing. To this conventional combination the invention interposes a connector means in the circuit between the detector and alarm which connector means includes a highly visible elongated external hanging electrical lead that is plugged into an opening in the housing to complete the circuit through the electrical lead thus, at all times, conspicuously indicating the armed/unarmed condition of the alarm.

3 Claims, 4 Drawing Figures

PORTABLE SMOKE ALARM

BACKGROUND OF THE INVENTION

1. Field of the Invention

The invention relates to a well-known type smoke alarm which is modified by making it portable and using a switch connector means in the circuit connecting the sensor and alarm which circuit is completed by engaging an external attached electrical lead that is highly visible.

2. Description of the Prior Art

Many smoke alarms are now available at low cost for use in residences of all kinds. They sense the abnormal conditions of smoke and/or fire by photo-electric, heat-sensing, and ionization means and all are well known. The alarms are mounted in a convenient place as a stairwell and usually comprise a combination of a smoke-detecting mechanism of any suitable type and a separate signal alarm means with a circuit connecting the detecting mechanism and alarm to provide a signal on the presence of the abnormal condition, such as smoke. As herein used and in the claims, the more common term "smoke" is intended to include fire, heat, or any other similar abnormal condition being sensed to trigger an alarm. These components are generally arranged in a compact, foraminous housing in a small package. The foraminations permit the entrance of the abnormal condition such as smoke so that it can be detected to activate the alarm. These alarms have become quite compact and low cost due to the use of small components and integrated circuitry and are battery operated or driven by the usual AC home voltage. Typical battery-operated smoke alarms may detect low battery voltage and signal a warning that a replacement battery is required, as in U.S. Pat. No. 4,030,086. Also, compactness is enhanced by the use of a piezoelectric horn of small size using few parts for easy assembly and compact size, as in U.S. Pat. Nos. 4,330,729 and 4,302,695, all three patents of common assignment. The compactness of smoke alarms also permits portability and such small devices are available for use in temporary residences such as hotel and motel rooms for use by travelers.

The portable alarms generally carry some means of attaching the alarm over a doortop or door handle or suitably setting it up in the room as a safety measure. Generally, all smoke alarms are required to indicate a low battery condition and usually are not designed to be inactivated conveniently for fear they would be turned off on false alarms and not reset. It is common to have to remove the battery or fan the air around the smoke detector in order to stop the alarm once sounded if it is not a true emergency condition. The need exists for a portable smoke alarm that, on brief inspection, is readily visible as armed or unarmed in order to lend utility to the device for traveling people.

It is therefore an object of this invention to provide a convenient arrangement for a portable alarm that can be easily armed or unarmed and whose condition is readily apparent on visual inspection.

Another object is to provide a portable alarm that is easily activated or armed but does not use a conventional ON/OFF switch that is easy to forget and leave in the OFF or inoperative position.

SUMMARY OF THE INVENTION

Briefly stated, in carrying out the invention a portable alarm is provided having a smoke detecting mechanism and a signal alarm means with a circuit connecting the mechanism and alarm to provide a signal on the presence of an abnormal condition such as smoke. These conventional components are housed in a compact, foraminous housing in a small package. The invention comprises modifying this conventional package by providing an electrical connecting circuit including an elongated electrical lead. The electrical lead is highly visible and extends outside of the housing to hang from the housing. Connecting means such as a phone plug is provided on one end of the electrical lead to connect to a matching phone jack for completing the electric circuit through the electrical lead. This combination provides an electrical lead forming a hanging appendage on the housing and visibly indicating the armed or unarmed condition of the alarm.

DESCRIPTION OF THE PREFERRED EMBODIMENT

Figure 1:
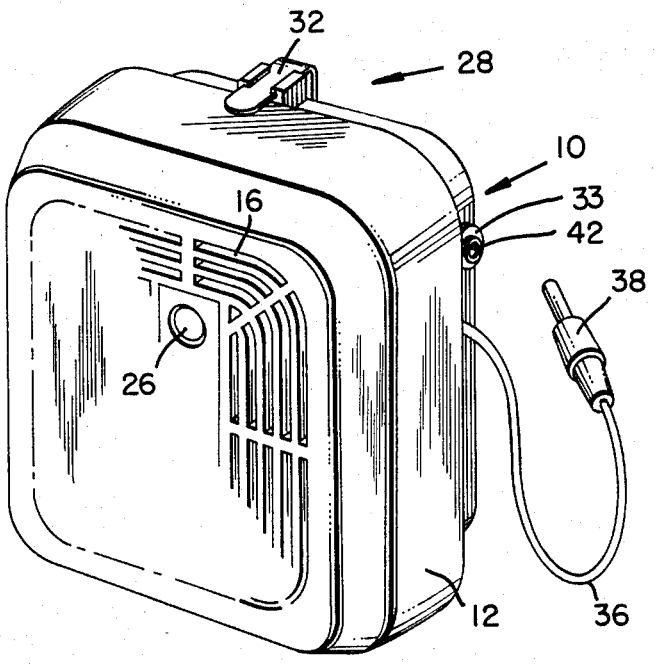
FIG. 1 is a perspective view of a typical smoke alarm showing the visible electrical lead appendage in the unarmed condition.
Figure 2:
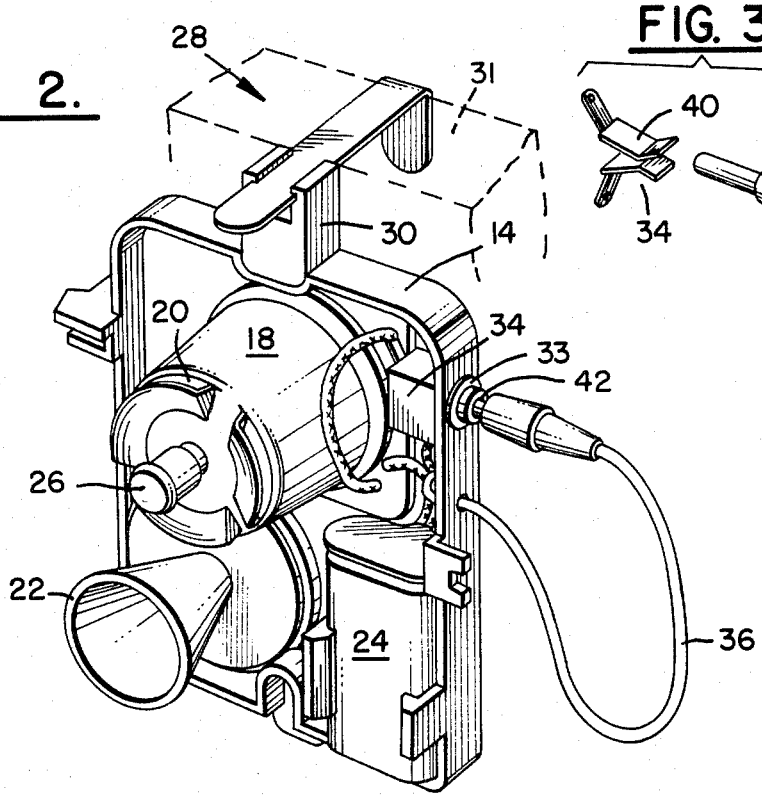
FIG. 2 is an internal perspective view of FIG. 1 showing the electrical lead in the inserted or armed condition; and, FIG. 3 is an exploded view of a typical phone plug type connector means that may be used in the circuit.

Referring to the drawings and particularly to FIG. 1, there is shown a standard smoke detector that is enclosed in a compact housing and formed of a foraminous plastic such as louvred cover 12 that is hinged to a back or base housing 14 on which the various internal components are mounted as shown in FIG. 2. The louvres 16 permit the entrance of smoke to be detected by the internals of the smoke detector as is well known. The internal components are quite small for an overall suitably shaped package that, by the use of modern components in a square shape, may be on the order of four to five inches square maximum. Normally, the packaged housing 10 is permanently attached at an appropriate place in a home such as the top of a stairwell to perform its emergency signaling in the presence of smoke. As shown in FIG. 2, the internal components are straightforward and include a suitable detecting mechanism 18 whose details are well known and which is mounted on the housing 14 and has slots 20 into which smoke may enter from louvres 16. To emit an audible alarm, a small piezoelectric horn 22 is also mounted on the back housing 14 as described in said U.S. Pat. No. 4,330,729 supra. A voltage or a power source is provided by a 9-volt battery 24 and all are interconnected by a circuit, that may be similar to said U.S. Pat. No. 4,030,086 supra. The arrangement is such that the circuit connects the smoke-detecting mechanism 18 with the signal alarm or horn 22 and is powered by a battery 24.

Generally, a signal button 26 may be pushed occasionally to close the circuit and test the smoke alarm. As described, this device is well known and presently available on the market.

In order to provide a more useful and flexible portable smoke alarm, the present arrangement has a hanger mechanism 28 that, conveniently, may be a plastic block 30 mounted on the housing and slotted to accommodate an L-shaped thin extendable hanger strap 32 having a long and a short leg as shown. The hanger strap 32 may be conveniently stacked for travel with the short leg in slotted block 30 as shown in FIG. 1 and then may be reversed by withdrawing and inserting the longer leg providing an elongated thin extendable adjustable hanger to fit over the top of a door 31 as shown in phantom in FIG. 2 when open or closed so the smoke alarm hangs inside the hotel room as will be apparent.

Figure 3:
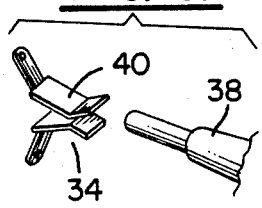
Figure 4:
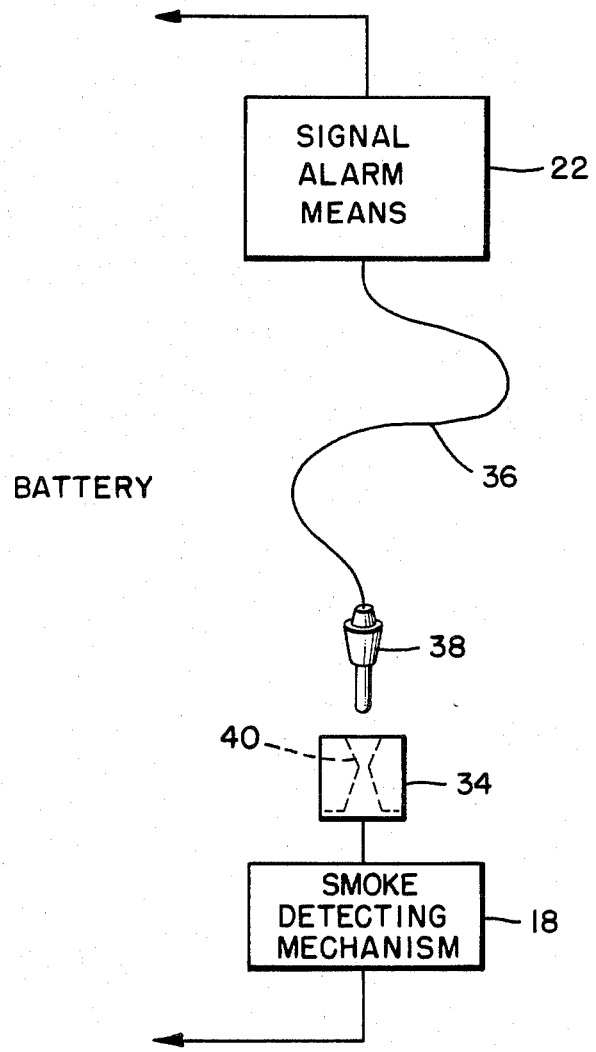
FIG. 4 is a simplified circuit diagram showing a preferred circuit connection of a typical phone plug type connector means.

In order to provide the necessary flexibility for a portable smoke alarm, the invention interrupts the normal connecting circuit within the smoke alarm by providing an opening 33 through the housing for first connector means 34 in the connecting circuit. For high visibility, an elongated electrical lead 36 is connected on the housing in the circuit to one side of the circuit and is of a length to extend outside the housing to hang therefrom with high visibility as shown in FIGS. 1 and 2. Thus, the circuit is electrically interrupted or completed through the electrical lead. The other end of the electrical lead includes a second connector means, which may be a simple phone plug 38, that connects to complete the circuit by any suitable means such as sliding between spring biased plates 40 (see FIG. 3) inside a matching jack 42 forming the connector means in the connecting circuit. This permits repeated use necessary in a portable device. A preferred circuit connection of phone plug 38 and first connector means 34 containing spring biased plates 40 is shown in FIG. 4. Thus, insertion of the plug 38 completes the circuit through the electrical lead and the activation or arming of the smoke alarm as shown in FIG. 2. The traveling or unarmed condition of the alarm is shown in FIG. 1 with the electrical lead extending in a highly visible condition outside the housing by hanging therefrom. Usually, the phone plug 38 and test button 26 are bright red for visibility.

Therefore, the smoke alarm of the present invention provides a compact portable smoke alarm that may be conveniently suspended by hanger 28 over any thickness of door when traveling and the entire device is normally completely unarmed—FIG. 1—by the hanging electrical lead entirely external of the smoke alarm. It is easily armed—FIG. 2—by inserting the electrical lead in the opening 33 in the housing to provide a device that is highly visible as to its armed/unarmed condition at all times.

While I have hereinbefore shown a preferred form of the invention, obvious equivalent variations are possible in light of the above teachings. It is therefore to be understood that, within the scope of the appended claims with the term "smoke" as defined above, the invention may be practiced otherwise than as specifically described and the claims are intended to cover such equivalent variations.

I claim:

1. In a portable alarm having a smoke detecting mechanism, a signal alarm means, and a compact foraminous housing enclosing the components in a small package, an electric circuit for selectively connecting and disconnecting the smoke detecting mechanism and the alarm means for respectively arming and unarming the alarm, said electric circuit comprising:

an elongated electrical lead connected at one end thereof to a selected one of said smoke detecting mechanism and said alarm means, said electrical lead extending visibly outside said housing from said one end thereof, first connector means connected to the other one of said smoke detecting mechanism and said alarm means, second connector means on the other end of said electrical lead to connect selectively to said first connector means to complete said electric circuit through said electrical lead so as to thereby arm the portable alarm, and said housing having extendable thin hanger means thereon capable of being reversed, said hanger means being adapted for hanging over a door top in open and closed door position or, upon reversal, to assume a compact position in contact with said housing, whereby said electrical lead forms a hanging appendage on the exterior of the housing to indicate in a highly visible form the armed/unarmed condition of the alarm.

2. Apparatus as described in claim 1 wherein said circuit is interrupted and an opening is disposed in the housing, said electrical lead end fitting in said opening to complete said circuit.

3. Apparatus as described in claim 2 wherein said electrical lead end is a phone plug, and said opening is a matching jack for repeated use.

* * * * *